US009217237B2

(12) United States Patent
Shimomura et al.

(10) Patent No.: US 9,217,237 B2
(45) Date of Patent: Dec. 22, 2015

(54) SIDE FRAME FOR CONSTRUCTION MACHINE

(71) Applicant: KOBELCO CONSTRUCTION MACHINERY CO., LTD., Hiroshima-shi (JP)

(72) Inventors: Keisuke Shimomura, Hiroshima (JP); Yasuhiko Shimazu, Hiroshima (JP)

(73) Assignee: KOBELCO CONSTRUCTION MACHINERY CO., LTD., Hiroshima-shi (JP)

( * ) Notice: Subject to any disclaimer, the term of this patent is extended or adjusted under 35 U.S.C. 154(b) by 0 days.

(21) Appl. No.: 14/571,432

(22) Filed: Dec. 16, 2014

(65) Prior Publication Data

US 2015/0191895 A1 Jul. 9, 2015

(30) Foreign Application Priority Data

Jan. 9, 2014 (JP) ..... 2014-002319

(51) Int. Cl.
*E02F 9/08* (2006.01)
*E02F 9/16* (2006.01)

(52) U.S. Cl.
CPC ..... *E02F 9/0883* (2013.01); *E02F 9/0816* (2013.01); *E02F 9/16* (2013.01)

(58) Field of Classification Search
CPC ..... B62D 55/06; B62D 55/065; E02F 3/36; E02F 3/342; E02F 3/358; E02F 9/16; E02F 9/121
See application file for complete search history.

(56) References Cited

U.S. PATENT DOCUMENTS

| | | | | |
|---|---|---|---|---|
| 5,711,095 | A * | 1/1998 | Oda et al. | 37/410 |
| 7,320,380 | B2 * | 1/2008 | Ueda et al. | 180/327 |
| 7,445,272 | B2 * | 11/2008 | Lee | 296/190.03 |
| 8,403,099 | B2 * | 3/2013 | Yokota | 180/309 |
| 2009/0101375 | A1 * | 4/2009 | Tsukui et al. | 172/776 |
| 2010/0025136 | A1 * | 2/2010 | Matsushita et al. | 180/68.3 |
| 2010/0283278 | A1 * | 11/2010 | Mamada et al. | 296/24.41 |
| 2011/0030353 | A1 * | 2/2011 | Kamiya et al. | 60/297 |
| 2011/0120085 | A1 * | 5/2011 | Saito et al. | 60/272 |
| 2012/0067660 | A1 * | 3/2012 | Kashu et al. | 180/296 |
| 2013/0149094 | A1 * | 6/2013 | Nakanishi et al. | 414/687 |
| 2013/0319787 | A1 * | 12/2013 | Kobayashi et al. | 180/309 |
| 2014/0021781 | A1 * | 1/2014 | Satake et al. | 307/9.1 |

FOREIGN PATENT DOCUMENTS

JP 5-42349 U 6/1993

* cited by examiner

*Primary Examiner* — Joseph Rocca
*Assistant Examiner* — Marc A Scharich
(74) *Attorney, Agent, or Firm* — Oblon, McClelland, Maier & Neustadt, L.L.P.

(57) ABSTRACT

The present invention aims to reduce the costs of construction machine by providing a side frame that can be shared by a plurality of construction machines of different models. A left side frame has: a cab support portion for supporting a cab; a cooler support portion provided behind the cab support portion to support a cooler; and a tank support portion provided between the cab support portion and the cooler support portion to support a tank. The tank support portion is configured to allow one of a first tank and a second tank that is different from the first tank in size in the right-and-left direction to be selectively attached to the tank support portion.

6 Claims, 7 Drawing Sheets

SIDE FRAME FOR CONSTRUCTION MACHINE

TECHNICAL FIELD

The present invention relates to a side frame to be provided in a construction machine such as a hydraulic shovel.

BACKGROUND ART

There has conventionally been known a construction machine with a lower traveling body, an upper slewing body slewably mounted on the lower traveling body, and a work attachment attached to the upper slewing body in a movable manner (e.g., Japanese Utility Model Application Publication No. H5-42349).

The upper slewing body described in Japanese Utility Model Application Publication No. H5-42349 has a main frame that is slewably supported on the lower traveling body and that allows the work attachment to be attached thereto in a movable manner, and side frames fixed to the sides of the main frame.

The upper slewing body also has a cab supported on the side frames and a tank (fuel tank) supported behind the cab on the side frames.

Because the capacity of such a tank provided in a construction machine generally varies depending on the model (size and weight) of the construction machine, a space for installing the tank on the side frame is needed, the space differing in size depending on the model of the construction machine.

Therefore, conventionally, a side frame provided with a tank support portion is prepared with respect to each model of the construction machines, the tank support portion having a size corresponding to the model of the construction machine.

This generates the need to create and manage a side frame for each construction machine model, increasing the costs of the construction machines.

SUMMARY OF INVENTION

An object of the present invention is to provide a side frame that can be shared by a plurality of construction machines of different models, so that the costs of the construction machines can be reduced.

In order to achieve this object, the present invention provides a side frame for a construction machine having a lower traveling body, a main frame slewably supported on the lower traveling body, and a work attachment attached to the main frame in a movable manner, the side frame, to be fixed to a side of the main frame, having: a cab support portion for supporting a cab of the construction machine; a cooler support portion provided behind the cab support portion to support a cooler of the construction machine; and a tank support portion provided between the cab support portion and the cooler support portion to support a tank of the construction machine, wherein the tank support portion is configured to allow one of a plurality of tanks whose sizes are different in a right-and-left direction to be selectively attached to the tank support portion.

According to the present invention, a cost of a construction machine can be reduced by providing a side frame that can be shared by a plurality of construction machines of different models.

DESCRIPTION OF EMBODIMENTS

An embodiment of the present invention is now described hereinafter with reference to the accompanying drawings. Note that the following embodiment is merely an example embodying the present invention and is not intended to limit the technical scope of the present invention.

Figure 1:
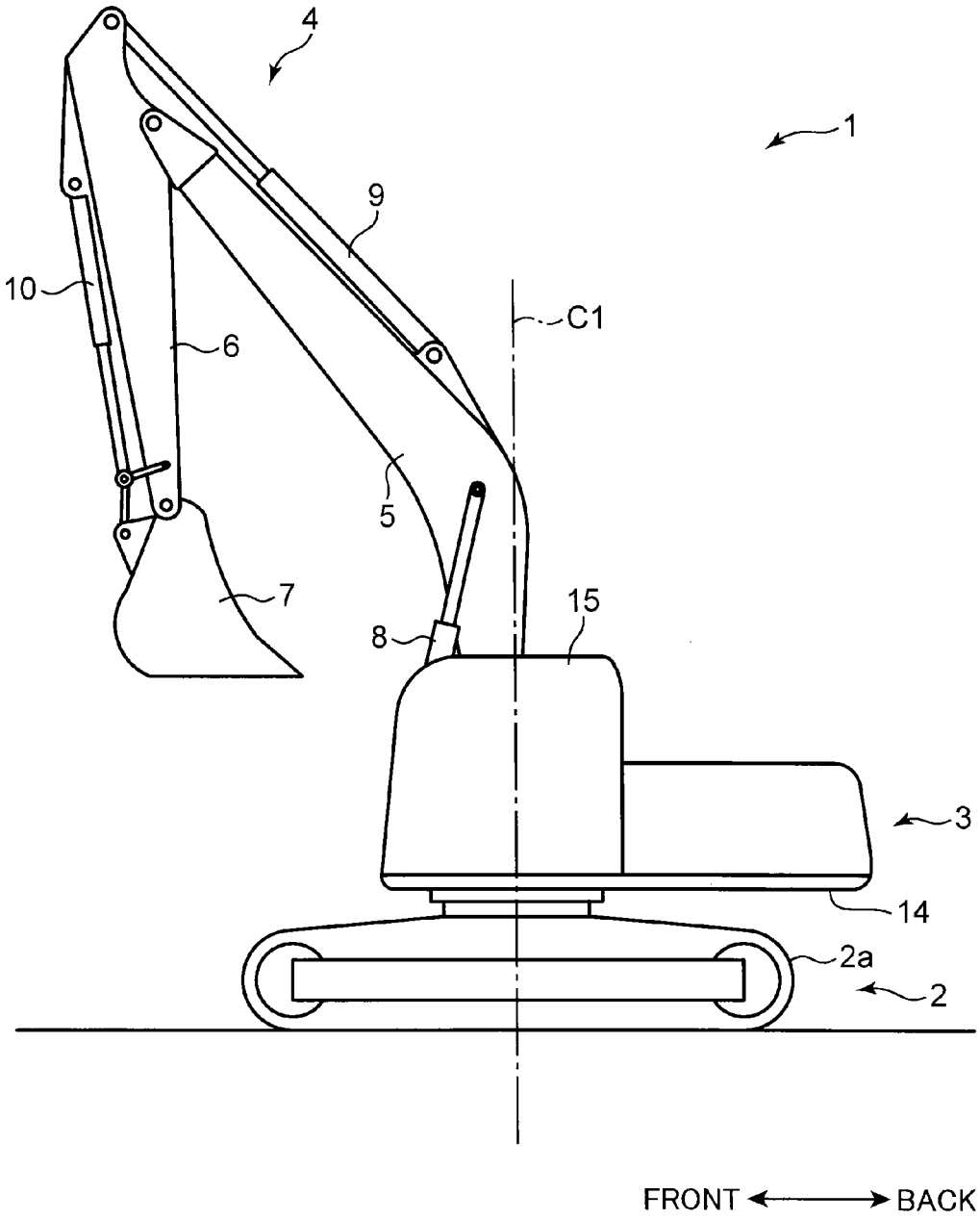
FIG. 1 is a left-side view of a hydraulic shovel according to an embodiment of the present invention.

FIG. 1 is a left-side view of a hydraulic shovel 1 which is an example of a construction machine according to an embodiment of the present invention.

The hydraulic shovel 1 has a self-propelled lower traveling body 2 with a crawler 2*a*, an upper slewing body 3 provided on the lower traveling body 2 so as to be slewable about a slewing axis C1, and a work attachment 4 that is attached to the upper slewing body 3 in a movable manner. In the following description, directions based on a perspective of an operator in a cab 15 described hereinafter are used. Note that the slewing axis C1 is an axis along the vertical direction (an up-and-down direction).

The work attachment 4 has a boom 5 attached so as to be able to move up and down with respect to the upper slewing body 3, an arm 6 attached so as to be able to rotate with respect to the distal end portion of the boom 5, and a bucket 7 attached so as to be able to rotate with respect to the distal end portion of the arm 6.

The work attachment 4 also has a boom cylinder 8 for moving the boom 5 up and down with respect to the upper slewing body 3, an arm cylinder 9 for driving to rotate the arm 6 with respect to the boom 5, and a bucket cylinder 10 for driving to rotate the bucket 7 with respect to the arm 6.

Figure 2:
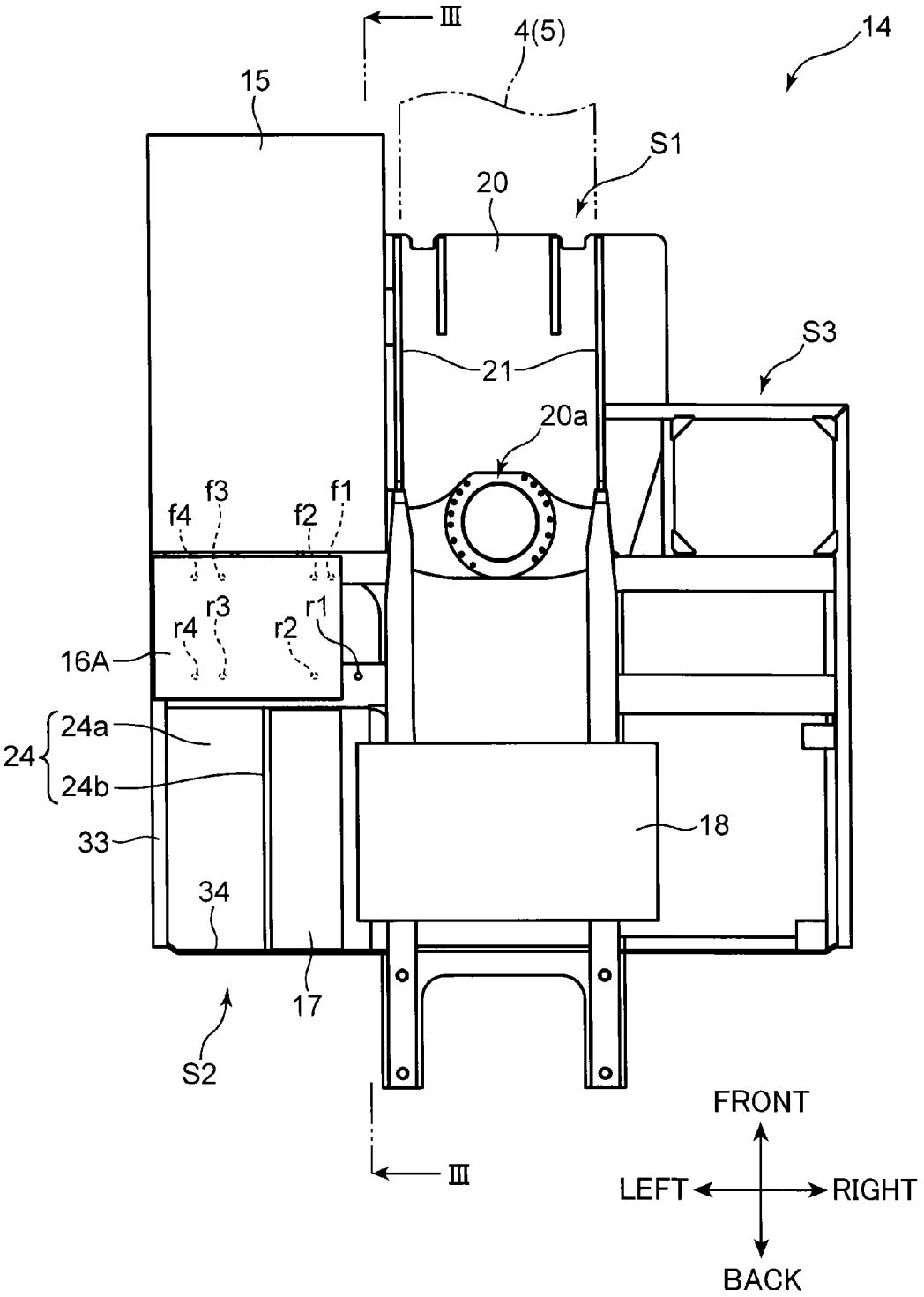
FIG. 2 is a plan view of an upper slewing body shown in FIG. 1, without an exterior cover.

As shown in FIGS. 1 and 2, the upper slewing body 3 has an upper frame 14, and a cab 15, a first fuel tank 16A, a cooler 17, and an engine 18 that are respectively provided on the upper frame 14. In FIG. 2, an exterior cover covering the top and sides of the fuel tank 16A, cooler 17, engine 18 and the like is omitted.

The cab 15 is provided at a left front portion of the upper frame 14.

The first fuel tank 16A is provided behind the cab 15.

The cooler 17 is provided behind the first fuel tank 16A. The cooler 17 is provided in order to cool the engine 18.

The engine 18 extends from the cooler 17 in a right direction.

Figure 4:
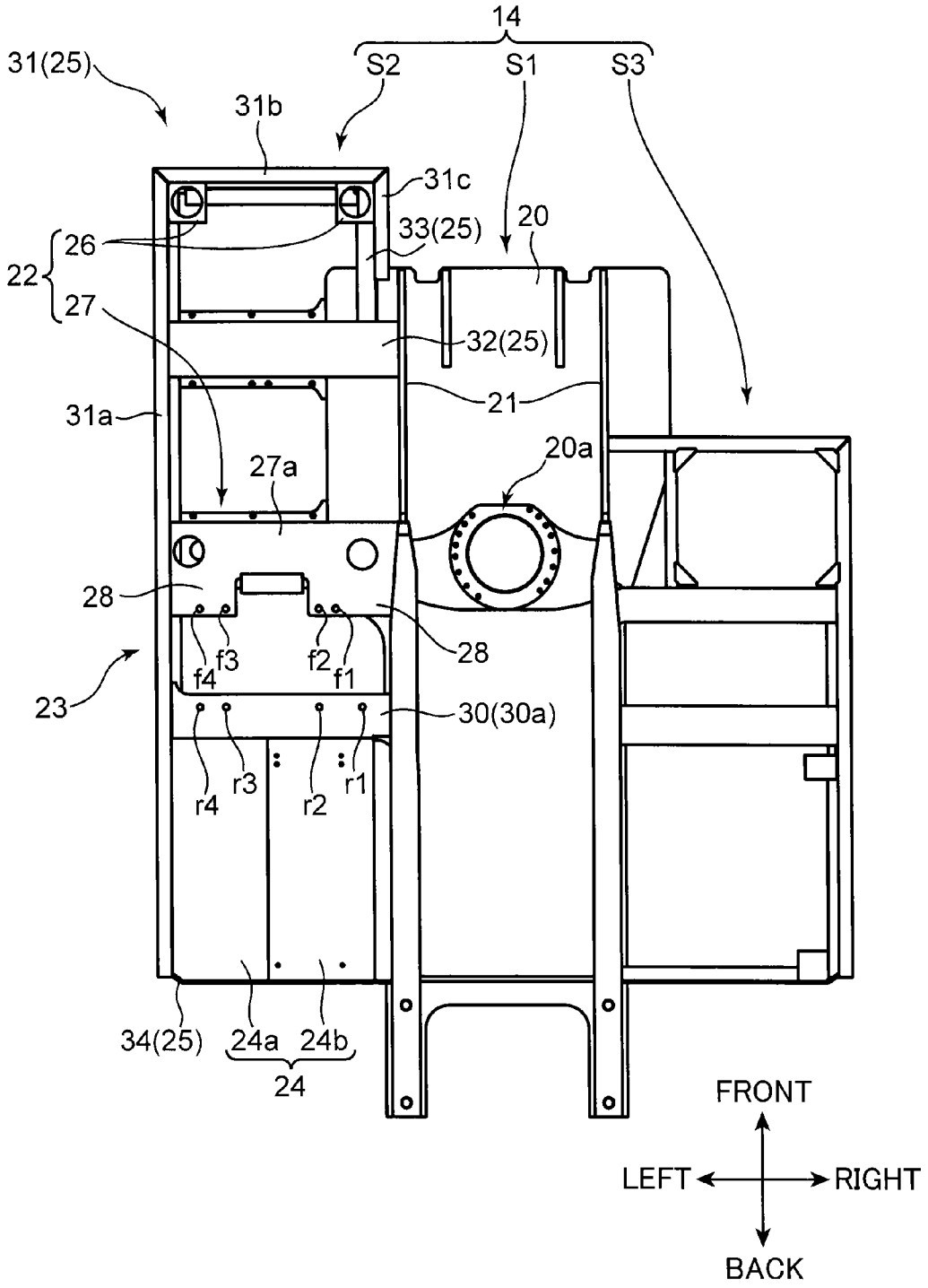
FIG. 4 is a diagram corresponding to FIG. 2, showing the upper slewing body without a cab, a fuel tank, and a cooler.

As shown in FIG. 4, the upper frame 14 has a main frame S1 slewably supported on the lower traveling body 2, a left side frame S2 fixed on the left side of the main frame S1, and a right side frame S3 fixed on the right side of the main frame S1.

The main frame S1 has a bottom plate 20 including an attached portion 20*a* to which a slewing bearing (not shown) is attached, and a pair of right and left vertical plates 21 standing on substantially the center of the bottom plate 20 in a right-and-left direction (lateral direction) and extending in a front-back direction.

The base end portion of the work attachment 4 (the boom 5) is disposed between the vertical plates 21 (see FIG. 2) and supported so as to be able to rotate about a boom foot pin, not shown, with respect to the vertical plates 21.

The left side frame S2 has a cab support portion 22 for supporting the cab 15 from below, a tank support portion 23 provided behind the cab support portion 22 to support the first fuel tank 16A from below, a cooler support portion 24 provided behind the tank support portion 23 to support the cooler 17 from below, and a coupling portion 25 for coupling the support portions 22 through 24 to one another. In other words, the cab 15 is placed on the cab support portion 22, the first fuel tank 16A (or a second fuel tank 16B, described hereinafter) on the tank support portion 23, and the cooler 17 on the cooler support portion 24.

The cab support portion 22 has a pair of right and left cab front support portion 26 for supporting the front portion of the cab 15 and a cab rear support portion 27 for supporting the rear portion of the cab 15.

Figure 3:
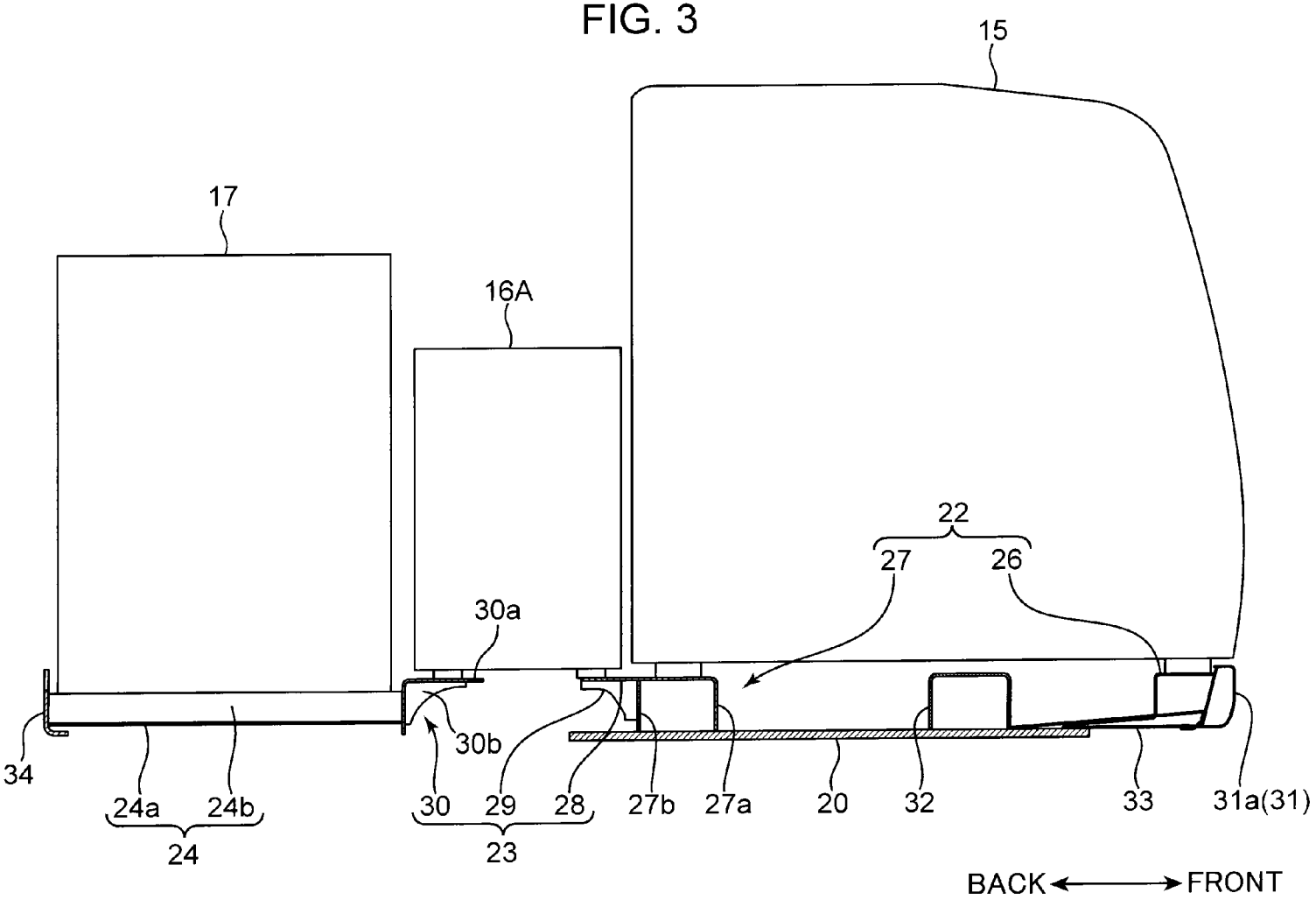
FIG. 3 is a cross-sectional diagram taken along line of FIG. 2.
Figure 5:
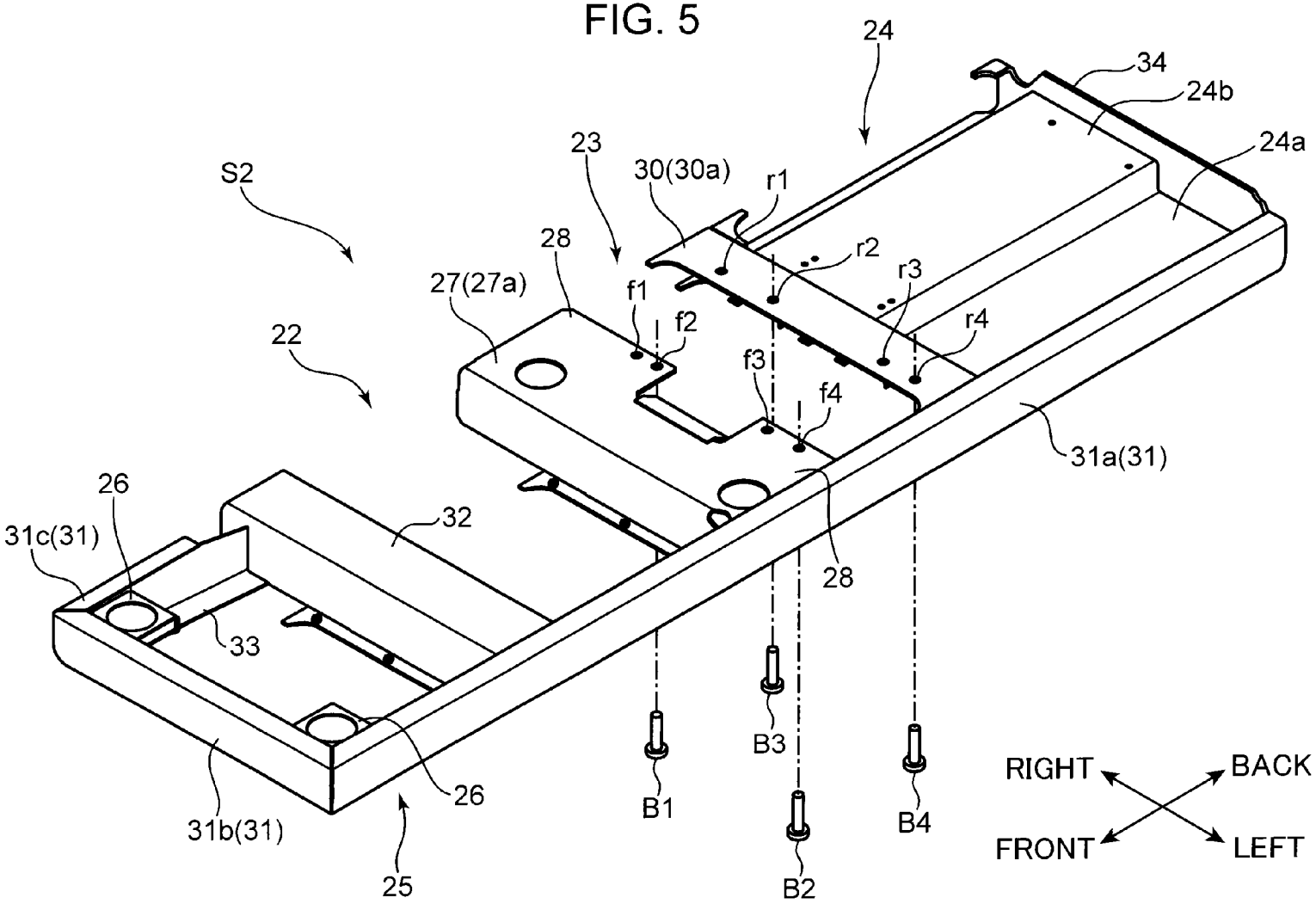
FIG. 5 is a perspective view showing an enlargement of a side frame shown in FIG. 4.

As shown in FIGS. 3 to 5, the cab rear support portion 27 is configured by a beam extending in the right-and-left direction. Specifically, the cab rear support portion 27 has a cab side bent plate 27*a* extending in the right-and-left direction and bent into an L shape as viewed from the side, and a support plate (vertical plate) 27*b* (see FIG. 3) extending in the right-and-left direction to support the cab side bent plate 27*a* from below.

The cab side bent plate 27*a* has a part disposed along the vertical direction (the up-and-down direction) as viewed from the side and a part extending from the upper end of the abovementioned part to the back and disposed substantially horizontally (horizontal plate). The support plate 27*b* has an upper end portion fixed to the lower surface of the part of the cab side bent plate 27*a* that is disposed substantially horizontally, and the support plate 27*b* is disposed along the vertical direction (the up-and-down direction) as viewed from the side. In other words, the support plate 27*b* extends downward from the part of the cab side bent plate 27*a* that is disposed substantially horizontally.

Figure 7:
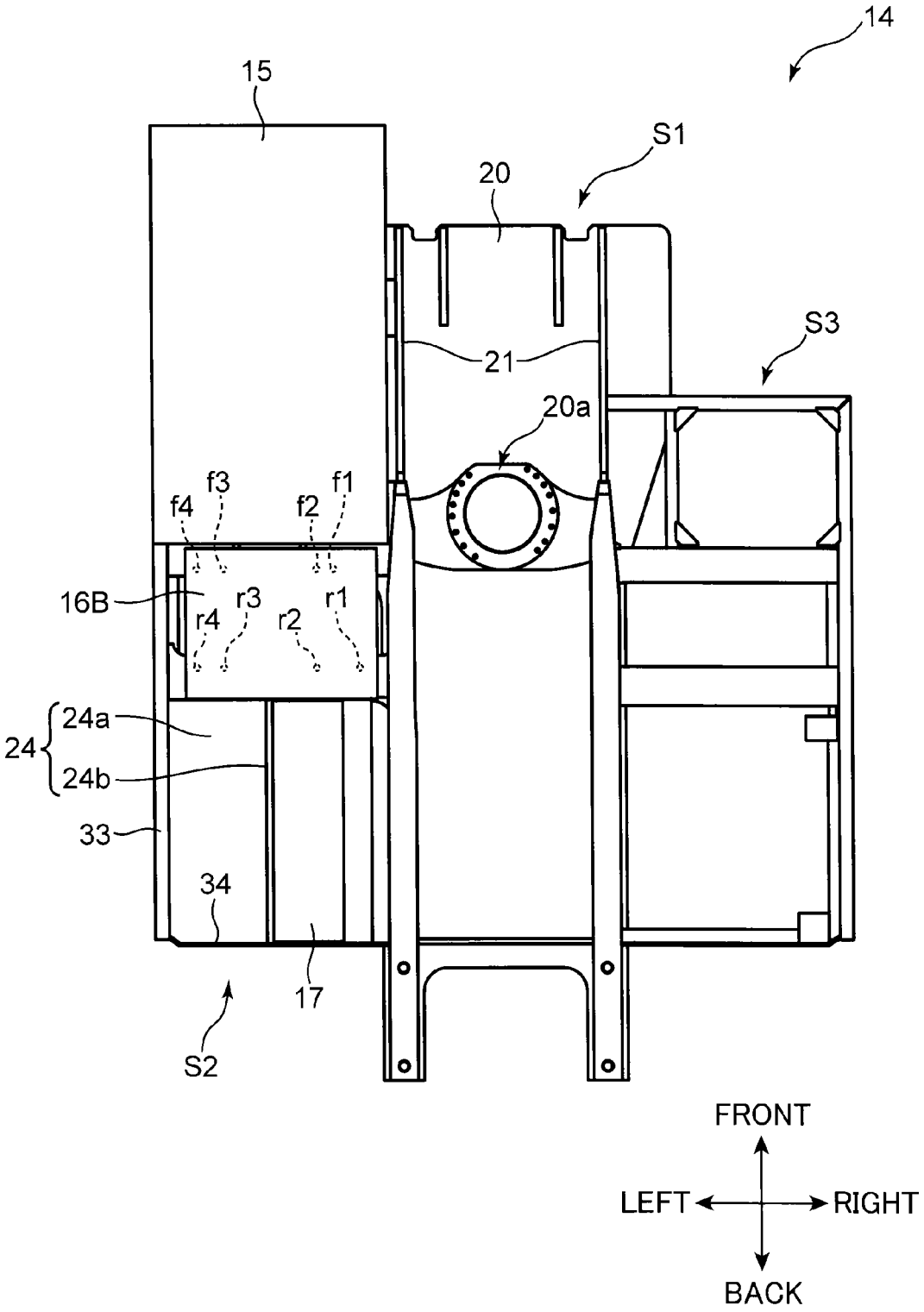
FIG. 7 is a diagram corresponding to FIG. 2, showing a state where a second fuel tank is supported.

The tank support portion 23 is configured to selectively support one of the first fuel tank 16A (see FIG. 2) and the second fuel tank 16B (see FIG. 7) that is larger than the first fuel tank 16A in the right-and-left direction.

The first fuel tank 16A and the second fuel tank 16B are selected according to the model (size and weight) of the hydraulic shovel 1. The tank support portion 23 can support only either one of the tanks 16A and 16B. The tanks 16A and 16B are generically referred to as "fuel tank 16" when not distinguished from each other.

Specifically, the tank support portion 23 has a pair of right and left tank front support portions (support plates) 28 for supporting the front portion of the fuel tank 16, two reinforcing plates (reinforcing members) 29 for reinforcing the tank front support portions 28 by supporting the tank front support portions 28 from below, and a tank rear support portion 30 for supporting the rear portion of the fuel tank 16 from below.

The front portions of the tank front support portions 28 are coupled to the rear portion of the cab support portion 22. More specifically, the tank front support portions 28 are each configured by a section of the cab side bent plate 27*a* of the cab support portion 22 which projects farther rearward than the support plate 27*b*. In other words, the tank front support portions 28 extend rearward from the cab support portion 22 in order to support the fuel tank 16.

The right-side tank front support portion 28 is provided with a first bolt hole f2 and a second bolt hole f1 punctured through this tank front support portion 28 in the vertical direction (the up-and-down direction). The left-side tank front support portion 28, on the other hand, is provided with a first bolt hole f4 and a second bolt hole f3 punctured through the tank front support portion 28 in the vertical direction (the up-and-down direction).

The bolt holes f1 to f4 are disposed in a line in the light-and-left direction. Specifically, the second bolt hole f1, the first bolt hole 12, the second bolt hole f3, and the first bolt hole f4 are arranged from the right in this order.

The first bolt holes f2 and f4 are configured to allow bolts B1 and B2 (see FIG. 5) to be inserted through the first bolt holes 12 and f4 from below in order to fix the first fuel tank 16A. The second bolt holes f1 and 13, on the other hand, are configured to allow bolts, not shown, to be inserted through the second bolt holes f1 and f3 from below in order to fix the second fuel tank 16B.

Figure 6:
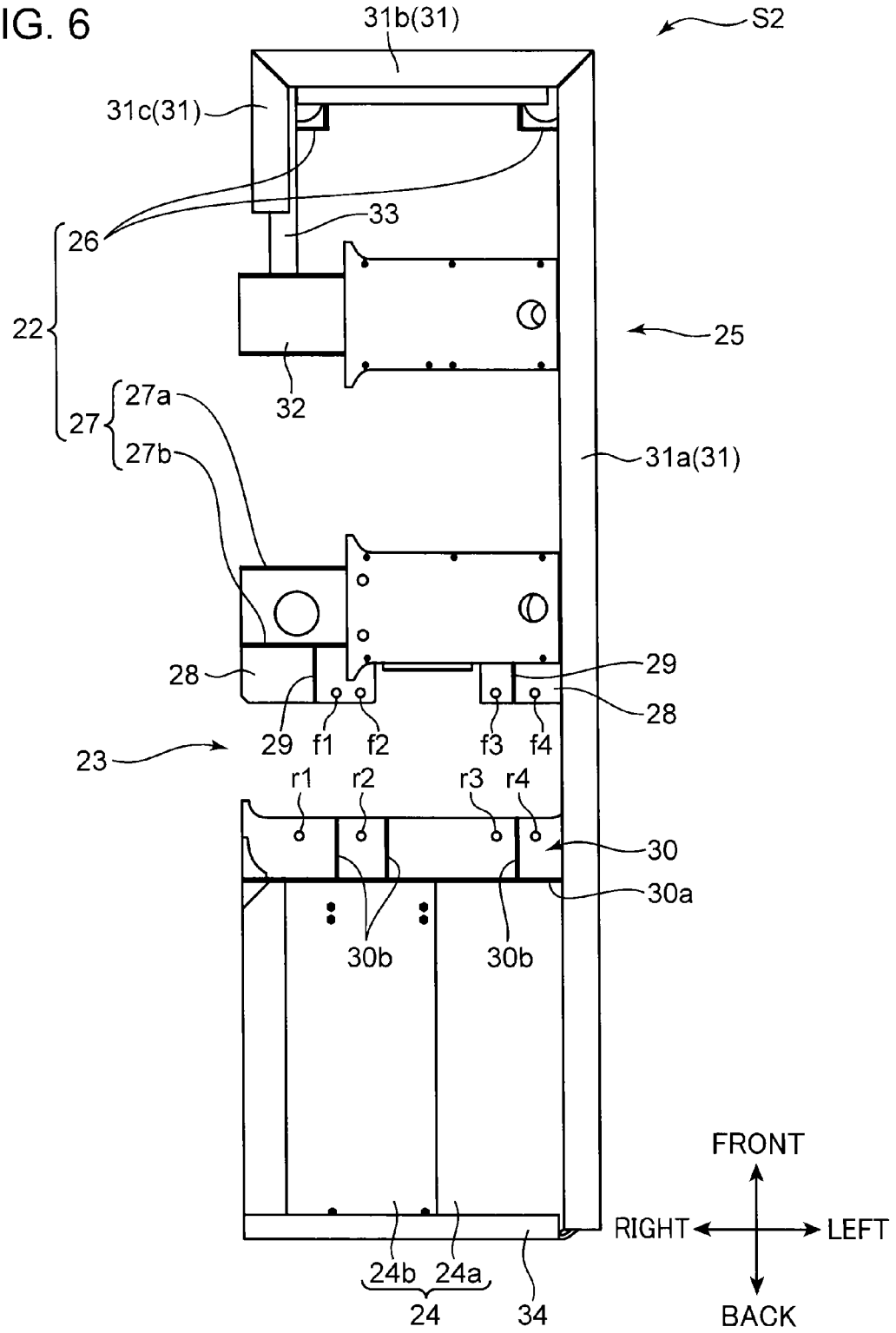
FIG. 6 is a bottom view of the side frame shown in FIG. 5.

As shown in FIGS. 3 and 6, one of the reinforcing plates 29 couples the lower surface of the right-side tank front support portion 28 and the rear surface of the support plate 27*b* to each other. This reinforcing plate 29 is provided on the right-hand side of the first and second bolt holes f2 and f1.

The other reinforcing plate 29 couples the lower surface of the left-side tank front support portion 28 and the rear surface of the support plate 27*b* to each other. This reinforcing plate 29 is provided between the first bolt hole f4 and the second bolt hole f3.

As described above, the reinforcing plates 29 are fixed to the lower surfaces of the tank front supports 28 and the rear surface of the support plate 27*b*.

As shown in FIGS. 3 to 5, the tank rear support portion 30 is configured by a beam extending in the right-and-left direction. Specifically, the tank rear support portion 30 has a tank side bent plate 30*a* extending in the right-and-left direction and bent into an L shape as viewed from the side, and three reinforcing plates (reinforcing members) 30*b* extending in the front-back direction to support the tank side bent plate 30*a* from below.

The tank side bent plate 30*a* has a section (vertical plate) disposed along the vertical direction (the up-and-down direction) as viewed from the side, and a section (support plate) extending forward from the upper end of the abovementioned section and disposed substantially horizontally. In other words, the section of tank side bent plate 30*a*, which is disposed along the vertical direction (the up-and-down direction) as viewed from the side, extends downward from the section of the tank side bent plate 30*a* that is disposed substantially horizontally.

The section of the tank side bent plate 30*a* that is disposed substantially horizontally supports the rear portion of the fuel tank 16 from below. The section of the tank side bent plate 30*a* that is disposed substantially horizontally is provided with a second bolt hole r1, a first bolt hole r2, a second bolt hole r3, and a first bolt hole r4, all of which are punctured through this section in the vertical direction (the up-and-down direction).

The bolt holes r1 to r4 are disposed in a line in the right-and-left direction. Specifically, the second bolt hole r1, the first bolt hole r2, the second bolt hole r3, and the first bolt hole r4 are arranged from the right in this order.

The first bolt holes r2 and r4 are configured to allow bolts B3 and B4 (see FIG. 5) to be inserted through the first bolt holes r2 and r4 from below in order to fix the first fuel tank 16A. The second bolt holes r1 and r3, on the other hand, are configured to allow bolts, not shown, to be inserted through the second bolt holes r1 and r3 from below in order to fix the second fuel tank 16B.

As shown in FIGS. 3 and 6, the reinforcing plates 30*b* are configured to couple the section (vertical plate) of the tank side bent plate 30*a* that is disposed along the vertical direction (the up-and-down direction), to the section (support plate) of the tank side bent plate 30*a* that is disposed substantially horizontally. In other words, the reinforcing plates 30*b* are fixed to the section of the tank side bent plate 30*a* that is disposed along the vertical direction (the up-and-down direction) and the section of the tank side bent plate 30*a* that is disposed substantially horizontally.

Of the three reinforcing plates 30*b*, the rightmost reinforcing plate 30*b* is provided between the second bolt hole r1 and the first bolt hole r2, the middle reinforcing plate 30*b* between the first bolt hole r2 and the second bolt hole r3, and the leftmost reinforcing plate 30*b* between the second bolt hole r3 and the first bolt hole r4.

As shown in FIGS. 3 to 5, the cooler support portion 24 is fixed to the rear surface of the tank rear support portion 30 and configured by a metal plate extending rearward from the tank rear support 30. Specifically, the cooler support portion 24 has a base portion 24*a* and a pedestal portion 24*b* projecting upward from the base portion 24*a*. The cooler 17 is supported on the pedestal portion 24*b*.

The coupling portion 25 has a reinforcing frame 31 for reinforcing the left side frame S2, a front beam 32 fixed to the reinforcing frame 31, a coupling plate 33 for coupling the front beam 32 and the reinforcing frame 31 to each other, and a rear plate 34 provided at the rear end of the reinforcing frame 31.

The reinforcing frame 31 has a closed cross-sectional shape (the cross-sectional shape in the form of an alphabet "D" as shown in FIG. 3). The reinforcing frame 31 also has a left portion 31*a* extending in the front-back direction to configure the left edge portion of the left side frame S2, a front portion 31*b* extending to the right from the front end portion of the left portion 31*a* to configure the front edge portion of the left side frame S2, and a right portion 31*c* extending rearward from the right end portion of the front portion 31*b* to configure the right edge portion of the left side frame S2.

The left end surface of the left-side cab front support portion 26, the left end surface of the front beam 32, the left end surface of the cab rear support portion 27, the left end surface of the left-side tank front support portion 28, the left end surface of the tank rear support portion 30, and the left end surface of the cooler support portion 24 are fixed (welded) to the right side surface of the left portion 31*a*.

The front end surfaces of the both cab front support portions 26 are fixed (welded) to the rear surface of the front portion 31*b*.

The right end surface of the right-side cab front support portion 26 is fixed (welded) to the left side surface of the right portion 31*c*.

The front beam 32 is provided in front of the cab rear support portion 27 and extends to the right from the right side surface of the left portion 31*a*.

The coupling plate 33 couples the right portion 31*c* and the right end portion of the front beam 32 to each other.

The rear plate 34 is a plate member extending to the right from the rear end portion of the left portion 31*a*. The rear end surface of the cooler support portion 24 is fixed (welded) to the front surface of the rear plate 34.

The configuration of the connection between the left side frame S2 and the main frame S1 is described next.

As shown in FIG. 4, the left end portion of the bottom plate 20 of the main frame S1 projects to the left beyond the left-side vertical plate 21. In a state where the right end portion of the front beam 32, the right end portion of the cab rear support portion 27, the right end portion of the tank rear support portion 30, and the right end portion of the cooler support portion 24 are placed on the left end portion of this bottom plate 20, the front beam 32, the cab rear support portion 27, the tank rear support portion 30, and the cooler support portion 24 are welded to the bottom plate 20.

The right end surface of the front beam 32, the right end surface of the cab rear support portion 27, the right end surface of the tank front support portion 28, the right end surface of the tank rear support portion 30, and the right end surface of the cooler support portion 24, are welded to the left side surface of the left-side vertical plate 21.

As described above, the hydraulic shovel 1 has the cab support portion 22 and the cooler support portion 24 for supporting respectively the cab 15 and the cooler 17, whose sizes fluctuate little regardless of the model of the hydraulic shovel 1, wherein the tank support portion 23 is provided between the support portions 22 and 24.

Therefore, because the tank support portion 23 of a constant size can be secured regardless of the model of the hydraulic shovel 1, the tank support portion 23 can be shared by the first fuel tank 16A and the second fuel tank 16B whose sizes are different in the right-and-left direction, by providing these first and second fuel tanks 16A and 16B in the range allowed by the tank support portion 23.

Therefore, a cost of the hydraulic shovel 1 can be reduced by providing the left side frame S2 that can be shared by the hydraulic shovel 1 having the first fuel tank 16A and the hydraulic shovel 1 having the second fuel tank 16B.

The foregoing embodiment can achieve the following effects.

According to the foregoing embodiment, the tank support portion 23 is provided with the first bolt holes f2, f4, r2 and r4 and the second bolt holes f1, f3, r1 and r3, which are located in different positions in the right-and-left direction. Therefore, the first fuel tank 16A and the second fuel tank 16B, whose sizes are different in the right-and-left direction, can be fixed to the tank support portion 23.

Although the two tanks (the first and second fuel tanks 16A and 16B) whose sizes are different in the right-and-left direction are illustrated above, the tank support portion 23 can be configured to allow three or more tanks whose sizes are different in the right-and-left direction to be attached to the tank support portion 23.

According to the foregoing embodiment, the front and rear portions of the first fuel tank 16A and the second fuel tank 16B can be supported (fixed) securely by the tank front support portion 28 and the tank rear support portion 30 respectively.

In this configuration, the first bolt holes f2, f4, r2 and r4 and the second bolt holes f1, f3, r1 and r3 are arranged in lines along the fight-and-left direction in the tank front support portion 28 and the tank rear support portion 30, respectively. Therefore, compared to when the first bolt holes and the second bolt holes are disposed in different positions in the front-back direction, the length of the tank support portion 23 can be made shorter in the front-back direction.

According to the foregoing embodiment, therefore, both secure support for the fuel tank 16 and downsizing of the left side frame S2 can be realized.

According to the foregoing embodiment, since the cab rear support portion 27 and the tank front support portion 28 are coupled to each other, the strength of the cab support portion 22 can be taken advantage of to securely support the fuel tank 16 by means of the tank front support portion 28.

In addition, since part of the cab support portion 22 and tank support portion 23 can be shared, the length of the left side frame S2 can be made shorter in the front-back direction, compared to when the cab support portion 22 and the tank support portion 23 are provided separately.

Furthermore, in the foregoing embodiment, as shown in FIG. 6, one of the reinforcing plates 29 is provided between the first bolt hole f4 and the second bolt hole f3, one of the reinforcing plates 30*b* is provided between the first bolt hole r2 and the second bolt hole r1, another reinforcing plate 30*b* is provided between the first bolt hole r3 and the second bolt hole r2, and the other reinforcing plate 30*b* is provided between the first bolt hole r4 and the second bolt hole r3.

Accordingly, the reinforcing functions of the tank front support portion 28 and the tank side bent plate 30*a* can be obtained by means of the reinforcing plates 29 and 30*b* when attaching the first fuel tank 16A and when attaching the second fuel tank 16B. As a result, while keeping the number of reinforcing plates 29 and 30*b* low, the effective reinforcement effect can be realized.

The section (support plate) of the tank side bent plate 30*a* that is disposed substantially horizontally and the section (vertical plate) of the tank side bent plate 30*a* that is disposed along the vertical direction (the up-and-down direction) are not only disposed perpendicular to each other but also coupled to each other by the reinforcing plate 30*b*, thereby effectively reinforcing the support plate.

The tank front support portion 28 (support plate) and the support plate 27*b* (vertical plate) are not only disposed perpendicular to each other but also coupled to each other by the reinforcing plate 29, thereby effectively reinforcing the tank front support portion 28.

Note that although the forgoing embodiment uses the fuel tanks 16 to describe the example of the tanks, the other tanks, including hydraulic oil tanks that are not shown, can also be employed as the tanks.

In addition, according to the foregoing embodiment, the bolt holes f2, f4, r2 and r4 for the first fuel tank 16A are provided separately from the bolt holes f1, f3, r1 and r3 for the second fuel tank 16B; however, the present invention is not limited thereto.

At least one of the bolt holes for only the first fuel tank 16A can be provided, and at least one of the bolt holes for only the second fuel tank 16B can be provided. And the rest of the bolt holes can be used for fixing both the first fuel tank 16A and the second fuel tank 16B.

Note that the specific embodiment described above mainly includes the inventions having the following configurations.

Specifically, the present invention provides a side frame for a construction machine having a lower traveling body, a main frame slewably supported on the lower traveling body, and a work attachment attached to the main frame in a movable manner, the side frame, to be fixed to a side of the main frame, having: a cab support portion for supporting a cab of the construction machine; a cooler support portion provided behind the cab support portion to support a cooler of the construction machine; and a tank support portion provided between the cab support portion and the cooler support portion to support a tank of the construction machine, wherein the tank support portion is configured to allow one of a plurality of tanks whose sizes are different in a right-and-left direction to be selectively attached to the tank support portion.

The side frame according to the present invention has the cab support portion and the cooler support portion for supporting the cab and the cooler, respectively, whose sizes fluctuate little regardless of the model of the construction machine. The side frame also has the tank support portion provided between these support portions of the side frame.

Therefore, because the tank support portion of a constant size can be secured regardless of the model of the construction machine, the tank support portion can be shared by a plurality of tanks whose sizes are different in the right-and-left direction, by providing the plurality of tanks in the range allowed by the tank support portion.

According to the present invention, therefore, a cost of a construction machine can be reduced by providing a side frame that can be shared by a plurality of construction machines of different models that have tanks whose sizes are different in the right-and-left direction.

Specifically, the plurality of tanks include a first tank and a second tank that is different from the first tank in size in the right-and-left direction. The tank support portion has a plurality of first bolt holes each configured to allow a bolt for fixing the first tank to the tank support portion to be inserted, and a plurality of second bolt holes each configured to allow a bolt for fixing the second tank to the tank support portion to be inserted. At least one of the first bolt holes and at least one of the second bolt holes are provided in different positions in the right-and-left direction.

According to this aspect, because the tank support portion has the first bolt holes and the second bolt holes that are provided in different positions in the right-and-left direction, the first tank and the second tank whose sizes are different in the right-and-left direction can selectively be fixed to the tank support portion by using these bolt holes.

In the side frame, it is preferred that the tank support portion has a tank front support portion for supporting front portions of the first tank and the second tanks, and a tank rear support portion for supporting rear portions of the first tank and the second tanks, and that at least one of the first bolt holes and at least one of the second bolt holes are provided in the tank front support portion and the tank rear support portion respectively, arranged in a line in the tank front support portion along the right-and-left direction, and arranged in a line in the tank rear support portion along the right-and-left direction.

According to this aspect, the front portion and rear portions of the first tank and the second tank can be supported (fixed) securely by the tank front support portion and the tank rear support portion.

Because the first bolt holes and the second bolt holes are arranged in lines along the right-and-left direction in the tank front support portion and the tank rear support portion, the length of the tank support portion can be made shorter in a front-back direction, compared to when the first bolt holes and the second bolt holes are disposed in the different positions in the front-back direction.

Consequently, according to the aspect, both secure support for the tanks and downsizing of the side frame can be realized.

In the side frame, it is preferred that the tank support portion has a support plate for supporting the tanks from below, and a reinforcing member for reinforcing the support plate by supporting the support plate from below, and that the reinforcing member is provided between the first bolt hole and the second bolt hole arranged in the right-and-left direction.

According to this aspect, the reinforcing functions of the support plate can be obtained by means of the reinforcing member when attaching the first tank and when attaching the second tank. As a result, while keeping the number of reinforcement members low, the effective reinforcement effect can be realized.

In the side frame, it is preferred that the support plate is disposed substantially horizontally, that the tank support portion further has a vertical plate extending downward from the support plate, and that the reinforcing member is fixed to the support plate and the vertical plate.

According to this aspect, the support plate can effectively be reinforced by disposing the support plate and the vertical plate perpendicular to each other and coupling the support plate and the vertical plate to each other by means of the reinforcing member.

In the side frame, it is preferred that a front portion of the tank support portion is coupled to a rear portion of the cab support portion.

According to this aspect, the strength of the cab support portion can be taken advantage of to securely support the tank by means of the tank support portion.

Since part of the cab support portion and tank support portion can be shared, the length of the side frame can be made shorter in the front-back direction, compared to when the cab support portion and the tank support portion are provided separately.

In the side frame, it is preferred that the cab support portion has a horizontal plate disposed substantially horizontally to support the cab, and a vertical plate extending downward from the horizontal plate, and that the tank support portion has a support plate extending rearward from the cab support portion to support the tanks from below, and a reinforcing member fixed to a lower surface of the support plate and a rear surface of the vertical plate.

According to this aspect, the support plate can effectively be reinforced by disposing the support plate and the vertical plate perpendicular to each other and coupling the support plate and the vertical plate to each other by means of the reinforcing member.

This application is based on Japanese Patent application No. 2014-002319 filed in Japan Patent Office on Jan. 9, 2014, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

The invention claimed is:

1. A side frame for a construction machine having a lower traveling body, a main frame slewably supported on the lower traveling body, and a work attachment attached to the main frame in a movable manner, the side frame configured to be fixed to a side of the main frame, the side frame comprising:

a cab support portion for supporting a cab of the construction machine;

a cooler support portion provided behind the cab support portion to support a cooler of the construction machine; and a tank support portion provided between the cab support portion and the cooler support portion to support a tank of the construction machine, wherein the tank support portion is configured to allow one of a plurality of tanks whose sizes are different in a right-and-left direction to be selectively attached to the tank support portion, a front portion of the tank support portion is coupled to a rear portion of the cab support portion, the cab support portion has a first part extending vertically in an up-and-down direction, a horizontal plate that extends rearward from an upper end of the first part and that is disposed substantially horizontally to support the cab, and a vertical plate that extends downward from the horizontal plate and that is disposed behind the first part, and the tank support portion has a support plate that extends rearward from the rear portion of the cab support portion to support the tank from below and the support plate is disposed behind the vertical plate.

2. The side frame for a construction machine according to claim 1, wherein the plurality of tanks include a first tank and a second tank that is different from the first tank in size in the right-and-left direction, the tank support portion has a plurality of first bolt holes each configured to allow a bolt for fixing the first tank to the tank support portion to be inserted, and a plurality of second bolt holes each configured to allow a bolt for fixing the second tank to the tank support portion to be inserted, and at least one of the first bolt holes and at least one of the second bolt holes are provided in different positions in the right-and-left direction.

3. The side frame for a construction machine according to claim 2, wherein the tank support portion has a tank front support portion for supporting front portions of the first tank and the second tank, and a tank rear support portion for supporting rear portions of the first tank and the second tank, and at least one of the first bolt holes and at least one of the second bolt holes are provided in the tank front support portion and the tank rear support portion respectively, arranged in a line in the tank front support portion along the right-and-left direction, and arranged in a line in the tank rear support portion along the right-and-left direction.

4. The side frame for a construction machine according to claim 3 wherein the tank front support portion includes the support plate, the tank rear support portion has a second support plate disposed substantially horizontally for supporting the tank from below, a second vertical plate extending downward from the second support plate, and a reinforcing member for reinforcing the second support plate by supporting the support plate from below, and the reinforcing member is fixed to the second support plate and the second vertical plate.

5. The side frame for a construction machine according to claim 2, wherein the tank support portion has a reinforcing member for reinforcing the support plate by supporting the support plate from below, and the reinforcing member is provided between the at least one first bolt hole and the at least one second bolt hole arranged in the right-and-left direction.

6. The side frame for a construction machine according to claim 1, wherein the tank support portion has a reinforcing member fixed to a lower surface of the support plate and a rear surface of the vertical plate.

* * * * *